US007594812B2

(12) United States Patent
Armanni

(10) Patent No.: US 7,594,812 B2
(45) Date of Patent: Sep. 29, 2009

(54) DOUBLE BURNER FOR GAS COOKERS, OF THE TYPE PROVIDED WITH MULTIPLE CONCENTRIC FLAME CROWNS

(75) Inventor: Piero Armanni, Forli' (IT)

(73) Assignee: SO. M. I Press - Societa' Metalli Iniettati, SpA, Castelfidardo (AN) (IT)

( * ) Notice: Subject to any disclaimer, the term of this patent is extended or adjusted under 35 U.S.C. 154(b) by 363 days.

(21) Appl. No.: 10/588,908

(22) PCT Filed: Jan. 17, 2005

(86) PCT No.: PCT/IT2005/000018

§ 371 (c)(1),
(2), (4) Date: Aug. 9, 2006

(87) PCT Pub. No.: WO2005/078342

PCT Pub. Date: Aug. 25, 2005

(65) Prior Publication Data

US 2007/0141521 A1 Jun. 21, 2007

(30) Foreign Application Priority Data

Feb. 13, 2004 (IT) ..... MC2004A0024

(51) Int. Cl.
*F23D 14/04* (2006.01)
*F23D 14/06* (2006.01)

(52) U.S. Cl. ..... 431/283; 431/278; 431/354; 126/39 E

(58) Field of Classification Search ..... 431/354, 431/278, 283–285; 126/39 E, 39 R
See application file for complete search history.

(56) References Cited

U.S. PATENT DOCUMENTS

| | | | | | |
|---|---|---|---|---|---|
| 856,582 | A * | 6/1907 | Harper | 239/416.5 |
| 1,047,200 | A * | 12/1912 | Gehring | 431/355 |
| 1,497,954 | A * | 6/1924 | Shaw et al. | 137/583 |
| 1,641,275 | A * | 9/1927 | Hughes | 239/431 |
| 1,922,348 | A * | 8/1933 | Beck | 239/419.5 |
| 1,962,251 | A * | 6/1934 | Magin | 126/39 N |
| 2,109,497 | A * | 3/1938 | Marvin et al. | 431/193 |
| 5,277,576 | A * | 1/1994 | Hartung et al. | 431/198 |
| 5,401,164 | A * | 3/1995 | Yen | 431/354 |
| 5,509,403 | A * | 4/1996 | Kahlke et al. | 126/39 E |
| 5,704,778 | A * | 1/1998 | Hsieh | 431/354 |
| 5,842,849 | A * | 12/1998 | Huang | 431/284 |
| 6,076,517 | A * | 6/2000 | Kahlke et al. | 126/39 J |
| 6,132,205 | A * | 10/2000 | Harneit | 431/354 |
| 6,322,354 | B1 * | 11/2001 | Carbone et al. | 431/284 |
| 6,325,619 | B2 * | 12/2001 | Dane | 431/284 |
| 6,332,460 | B1 * | 12/2001 | Paesani | 126/39 R |

(Continued)

FOREIGN PATENT DOCUMENTS

EP 0 638 771 * 2/1995

(Continued)

*Primary Examiner*—Carl D Price

(57) ABSTRACT

The present invention refers to a double burner for gas cookers, of the type provided with multiple concentric flame crowns (FE, FC), which comprises two gas inlet (3, 4) that reach the centre of the body (1) at a slightly different height, so that communication can be provided between the gas inlets, if necessary, by simply drilling a hole (15) with vertical axis from the upper inlet (3) to the lower inlet (4).

7 Claims, 4 Drawing Sheets

U.S. PATENT DOCUMENTS

| | | | | |
|---|---|---|---|---|
| 6,780,008 | B2 * | 8/2004 | Koch et al. | 431/354 |
| 7,140,363 | B2 * | 11/2006 | Armanni | 126/214 R |
| 2007/0059654 | A1 * | 3/2007 | Armanni | 431/8 |
| 2009/0047611 | A1 * | 2/2009 | Armanni | 431/284 |

FOREIGN PATENT DOCUMENTS

| | | | |
|---|---|---|---|
| FR | 2 650 369 | | 6/1990 |
| FR | 2650369 | A1 * | 2/1991 |
| WO | PCT/DK97/00352 | | 8/1997 |
| WO | WO 9908046 | A1 * | 2/1999 |
| WO | WO 9911956 | A1 * | 3/1999 |
| WO | WO 03/036168 | * | 5/2003 |
| WO | WO 2004044490 | A1 * | 5/2004 |

* cited by examiner

DOUBLE BURNER FOR GAS COOKERS, OF THE TYPE PROVIDED WITH MULTIPLE CONCENTRIC FLAME CROWNS

The present patent application refers to a double burner for gas cookers, of the type provided with multiple concentric flame crowns.

The expression "double burner" is used to indicate a burner with two different gas inlets provided with taps that supply gas to two or more concentric flame crowns separately. The flame crowns can be turned on or off selectively, since gas is supplied by means of two separate independent channels ending into the aforementioned inlets.

In spite of being provided with multiple concentric flame crowns, traditional burners are characterized by the presence of one gas inlet with tap, which feeds all channels used to bring the air-gas mixture to the burner head.

In view of the above, concentric flame crowns of traditional burners operate simultaneously, meaning they are turned on or off together. On the contrary, with double crowns the user can decide whether to turn all flame crowns on or keep some of the crowns off.

The purpose of the present invention is to devise a double burner for gas cookers capable of being converted with simple, inexpensive modifications into a standard burner, that is to say a burner with one tap mounted near one of the inlets, without losing the possibility of supplying gas to all flame crowns of the double burner.

In order to modify the existing models of double burners, a connection pipe must be applied outside the body of the burner to provide communication between the mouths of the two gas inlets, so that the gas introduced in one inlet can flow freely through the connection pipe towards the other inlet that, consequently, does not require to be connected to the gas supply and equipped with a tap.

The purpose of the present invention is to devise a double burner for gas cookers that can be converted into a standard burner without the introduction of external elements, such as the connection pipe situated outside the body of the burner, by simply removing the internal wall of the body that separates the two gas inlets.

An additional purpose of the present invention is to devise a double burner for gas cookers that can be converted as illustrated above, characterised by versatility of use thanks to the replacement of some elements according to different market requirements.

It is worth mentioning that pots with flat bottom are normally used in Western countries for cooking, while the use of pots with spherical bottom is popular in Asian countries.

In the latter case, to ensure good thermal performance of burners, the flames should be tilted upwards, while in the first case the flames should have a perfectly horizontal direction.

In view of the considerations above, the double burner of the invention has been designed in such a way as to be equipped with two types of interchangeable caps, with the first cap being suitable for emission of flames in horizontal direction and the second cap being suitable for emission in vertical direction.

A further purpose of the present invention is to devise a double burner for gas cookers characterised by the aforementioned modification and versatility of use and provided with compact volume.

The burner of the invention traditionally comprises a tub-shaped body that contains partition walls used to define two different, not-communicating channels, of which one channel is used to supply gas to the external flame crowns and one channel is used to supply gas to the central flame crowns.

The bottom of the body traditionally features two different, not-communicating gas inlets with horizontal axes used to supply gas to the aforementioned channels selectively.

According to the burner of the invention, the two gas inlets are characterised by the fact that they both reach the centre of the body at a slightly different height. Because of the above, communication between the inlets can be provided, if necessary, by simply drilling a hole with vertical axis from the upper inlet to the lower inlet.

According to the preferred embodiment of the present invention, the axes of the two inlets lay on orthogonal vertical planes.

Although U.S. Pat. No. 6,332,460B1 discloses a burner having the aforementioned characteristic it lacks compactness in height and features only two overlapped crowns positioned on two different levels so that the flames of the lower crown are spaced out with respect to the flames of the upper crown.

The considerable size in height of said burner depends on the fact that the three venture-ducts combined with respective three nozzles have vertical axis.

On the contrary the burner according to the invention applies an opposed pair of Venturi chambers with inclined axis.

Said inclined axis allows for reducing the size of the burner in height without reducing the length of the diverging section of said chambers, said length being responsible for the quality of the burner performances.

Moreover, thanks to said inclined axis the burner size in length is controlled, should a three-crown burner with concentric flames on the same level be realised.

A three-crown burner with concentric flames placed on the same level is described in U.S. patent pub. No. 2001/0010897A1, however the size in height and length of this type of burners is considerable since they adopts a first gas injector followed by a Venturi chamber with vertical axis and a second gas injector followed by a Venturi chamber with horizontal axis so as to feed the external flames of the two crowns.

As specified above the burner according to the invention encloses two gas inlets.

A vertical channel branches off from the upper inlet provided with the first gas nozzle designed to introduce gas into the supply channel of central flame crowns, while a diverging pair of ascending channels branches off from the lower inlet provided with nozzles designed to introduce gas into the supply channel of external flame crowns.

A Venturi chamber is provided downstream each gas nozzle to favour mixing of gas with primary air.

The burner of the invention has three Venturi chambers, one central chamber with vertical axis above the first nozzle and two chambers in opposite position with inclined axis, respectively above the other two aforementioned nozzles.

The chambers are situated inside the head of the burner, that is to say the circular dish characterised by the presence of a concentric series of multiple toothed crowns, where caps rest to close the cavities of the toothed crowns, it being known that flames come out from each cavity.

Another characteristic of the burner of the invention consists in the fact that it comprises a head formed by a lower dish and an upper dish that perfectly match together to define the opposite pair of Venturi chambers with inclined axis.

The third Venturi chamber is situated in central position in the upper dish, which is provided with the concentric series of multiple toothed crowns.

For major clarity the description of the double burner of the invention continues with reference to the enclosed drawings, which are intended for purposes of illustration only and not in a limiting sense, whereby:

Figure 1:
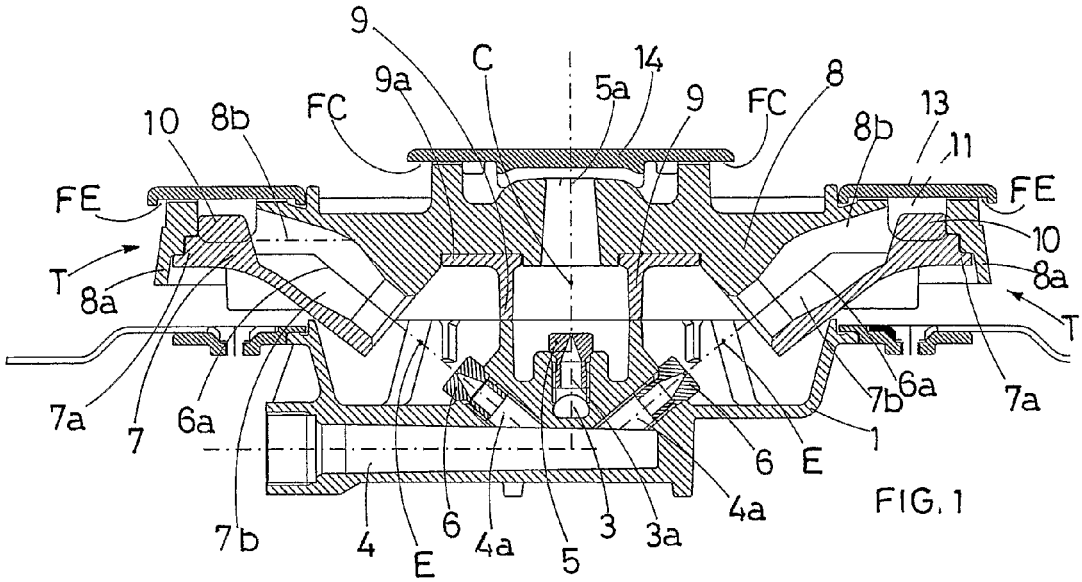
FIG. 1 is a cross-section of the burner of the invention with a vertical diametral plane passing through the axis of the first gas inlets.
Figure 2:
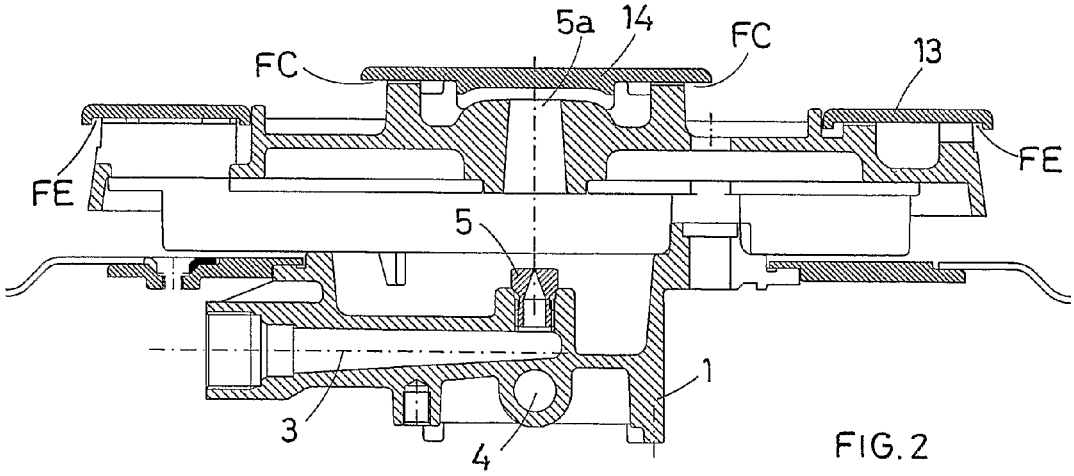
FIG. 2 is a cross-section of the burner of the invention with a vertical diametral plane passing through the second gas inlet, which in this case is at a higher height than the first inlet.

With reference to FIGS. 1 and 2, the double burner of the invention traditionally comprises a circular body (1) that contains partition walls used to define two different, not-communication channels, of which channel (E) is used to supply gas to the crowns of external flames (FE) and channel (C) to supply gas to central flames (FC).

The bottom of the body (1) traditionally features two different, not-communicating gas inlets (3 and 4) used to supply gas to channels (C and E), selectively and respectively.

The two gas inlets (3 and 4) reach the centre of the body (1) at a slightly different height; more precisely, the upper inlet (3) exactly ends in the centre of the body (1) and the lower inlet (4) goes beyond the centre.

A vertical channel (3*a*) branches off from the upper inlet (3) provided with the first gas nozzle (5), that is to say the nozzle used to supply gas into the central channel (C) that feeds the central flame crowns (FC), while a diverging pair of ascending channels (4*a*) branches off from the lower inlet (4) provided with gas nozzles (6) used to supply gas into the channel (E) that feeds the crowns of external flames (FE).

A Venturi chamber (5*a*) with vertical axis is provided downstream the nozzle (5), and a pair of Venturi chambers (6*a*) with inclined axis, preferably from 40 to 60°, is provided downstream the pair of nozzles (6).

Moreover, the burner of the invention comprises a head (T) formed by a lower dish (7) and an upper dish (8) that match perfectly.

More precisely, the lower dish (7) has a truncated conical shape and a stepped external border (7*a*) that acts as support and centring for the upper dish (8) provided with a stepped perimeter collar (8*a*).

The upper dish (8) finds a second centring and support in the flat flange (9*a*) located at the upper end of the partition walls (9) that project from the centre of the body (1) and separate the channels (C and E).

The nozzle (5) is situated in central position inside the partition walls (9), while the nozzles (6) are situated in external opposite position with respect to the walls (9).

Figure 6:
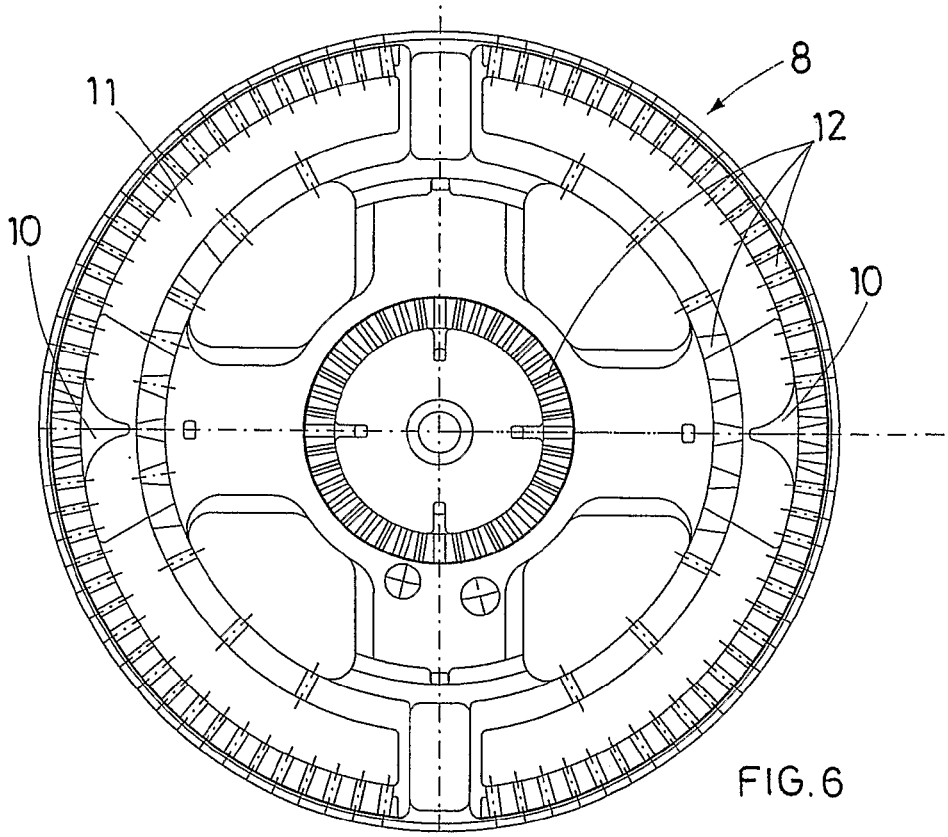
FIG. 6 is a top view of the head of the burner without caps.
Figure 7:
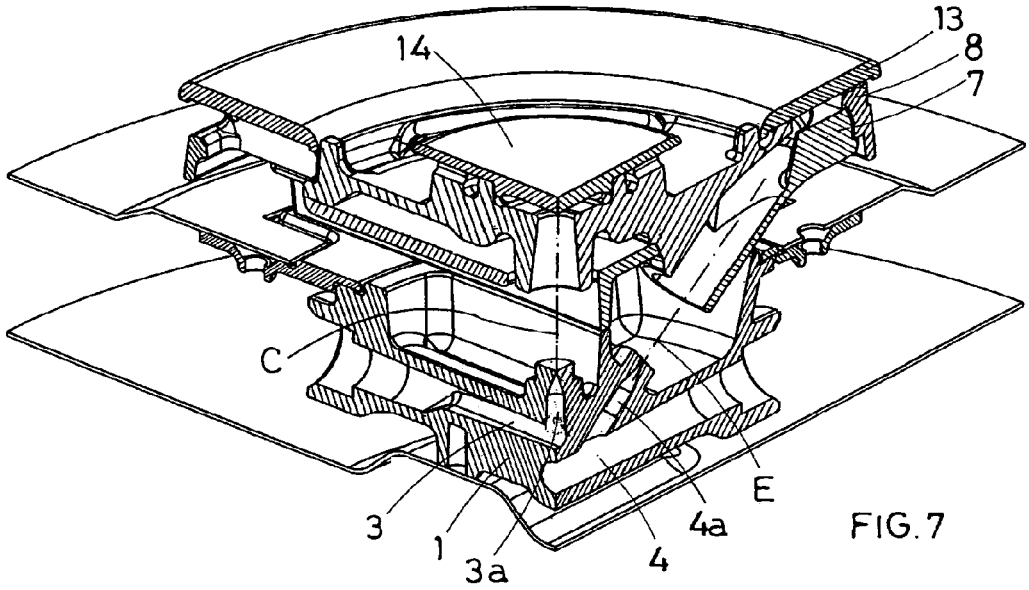
FIG. 7 is an axonometric view of the burner of the invention, sectioned with two orthogonal vertical planes passing through the axes of the two gas inlets, respectively.

The two dishes (7 and 8) are provided with semi-conduits (7*b* and 8*b*) that form the aforementioned Venturi chambers (6*a*). A V-shaped deflector wall (10) is situated downstream the chambers (6*a*) on the lower dish (7) to favour the bifurcation of the air-gas flow coming from the chambers (6*a*), which is conveyed inside a semi-circular corridor (11) and feeds the concentric crowns of central flames (FC), as shown in FIG. 6, in which the three toothed crowns (12) situated above the upper dish (8) are clearly visible.

The corridor (11) is closed by an annular cap (13), on whose external border the concentric crowns of external flames (FE) are formed.

The Venturi chamber (5) is situated inside the upper dish (8) and ends a circular space laterally closed by the toothed crown (12) with lower diameter and by a circular cap (14), on whose external border the concentric crown of central flames (FC) is formed.

Figure 3:
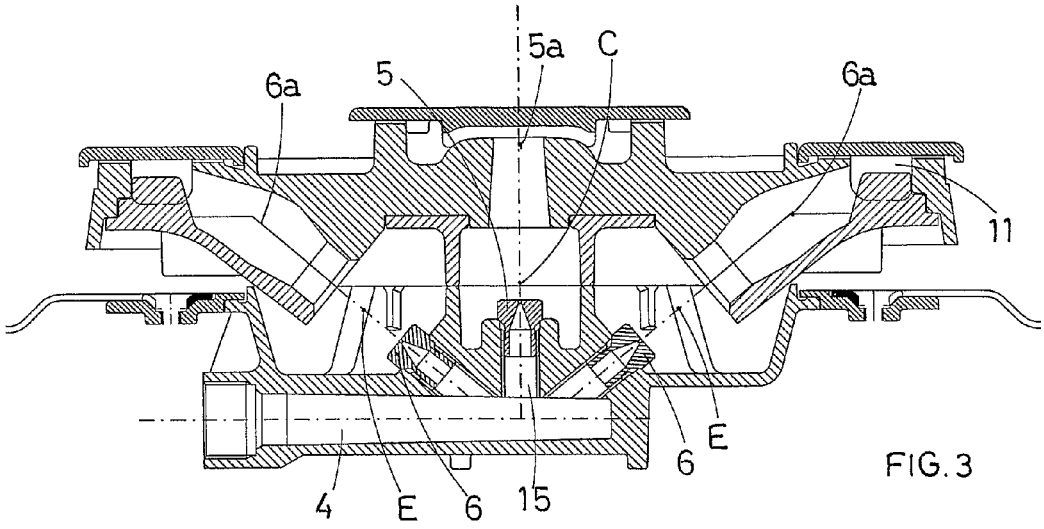
FIG. 3 is the same cross-section as FIG. 1, except for the fact that it refers to the converted version of the burner, as shown by the communication created between the two gas inlets by means of a hole with vertical axis.

As shown in FIG. 3, the double burner of the invention can be converted into an ordinary burner with three concentric flame crowns by drilling a hole with vertical axis (15) on the body in central position from the lower gas inlet (4) to the coaxial vertical channel (3*a*) with the nozzle (5).

The simple connection of the lower inlet (4) to the gas supply allows to feed the three nozzles—that is to say the central (5) and the lateral (6) nozzles—simultaneously, it being evident that in this case the upper gas inlet (3) must be closed to prevent the gas introduced in the lower inlet (4) from exiting the body of the burner by travelling backwards in the upper inlet (3).

Figure 4:
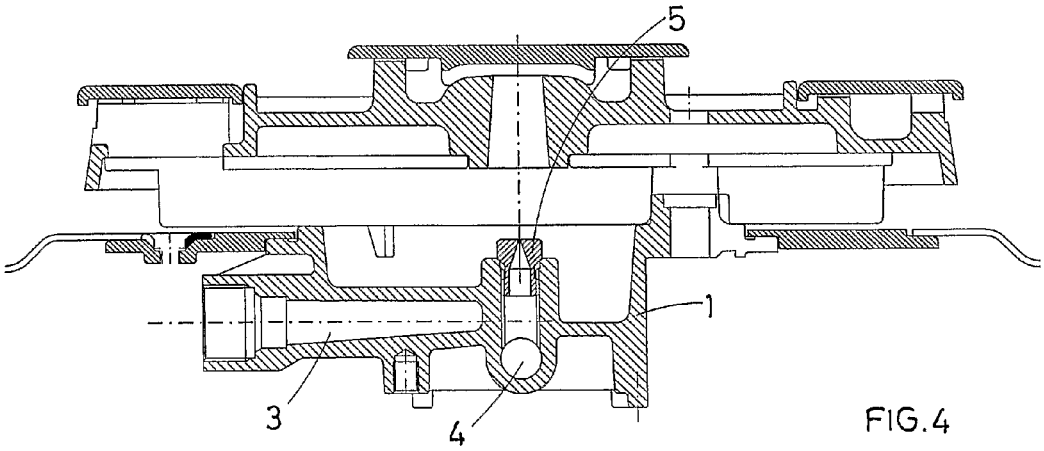
FIG. 4 is the same cross-section as FIG. 2, except for the fact that it refers to the converted version of the burner, as shown by the communication created between the two gas inlets by means of a hole with vertical axis.
Figure 5:
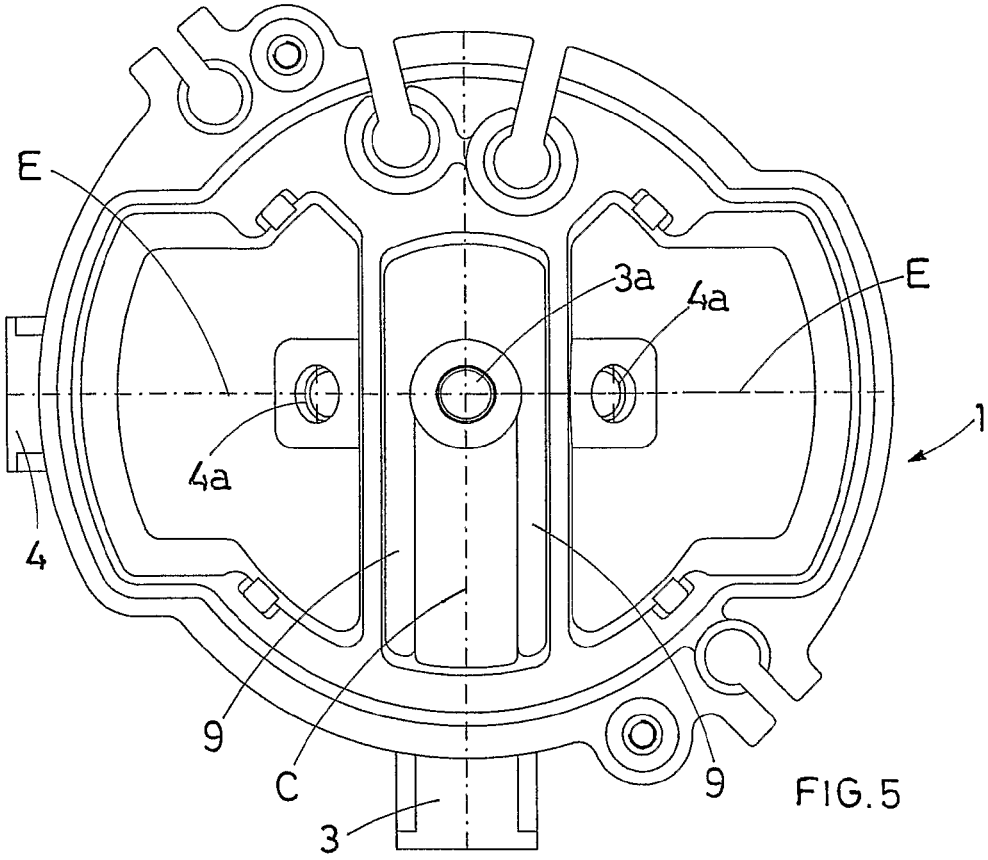
FIG. 5 is a top view of the body of the burner of the invention.

In order to avoid using external elements, such a closing cap for the inlet (3), the length of the inlet (3) can be suitably reduced, as shown in FIG. 4.

Since the body (1) is obtained from die-casting, the reduction in length can be easily and economically obtained by simply moving backwards the pin that is used as "core" for the upper inlet (3).

Figure 8:
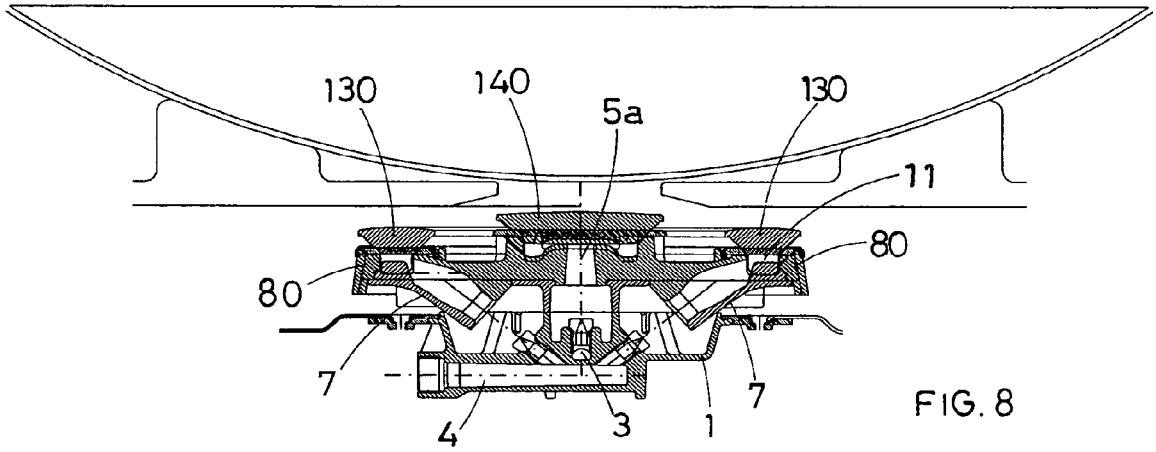
FIG. 8 is the same cross-section as FIG. 1, except for the fact that it refers to the version of burner with caps to favour the creation of flames with vertical inclination.

As shown in FIG. 8, to give a vertically inclined direction to the flames, the upper dish (8) and the caps (13 and 14) must be replaced with another dish (80) and two caps (130 and 140) with suitable shape, without having to modify the configuration of the body (1) and the lower dish (7).

Finally, it must be noted that the presence of two Venturi chambers (6*a*) with inclined, rather than vertical, axis allows to reduce the height of the burner.

The invention claimed is:

1. Double burner for gas cookers, of the type provided with multiple concentric flame crowns, which comprises:

one head (T) with multiple concentric flame crowns, a first flame crown of external flames (FE) and a second flame crown of central flames (FC);

one circular body (1) having a centre, a bottom and partitions (9) used to define two different, not-communicating channels, a first channel (E) used to supply gas to the external flames (FE) and a second central channel (C) to supply gas to the central flames (FC);

two separate, not-communicating gas inlets, an upper inlet (3) and a lower inlet (4), both inlets being situated on the bottom of the body (1), the upper inlet being used to supply gas to the second channel and the lower inlet being used to supply gas to the first channel, the upper inlet (3) exactly ending in the centre of the body (1) and the lower inlet (4) extending beyond the centre of the body;

burner having a vertical channel (3*a*) branching off from the upper inlet (3), said vertical channel (3*a*) being provided with a first gas nozzle (5) designed to introduce gas into the second central channel (C), a diverging pair of ascending channels (4*a*) branching off from the lower inlet, a respective nozzle (6) being disposed in each ascending channel designed to introduce gas into the first channel (E); a Venturi chamber (5*a*) with vertical axis is situated downstream the first nozzle (5), and a pair of Venturi chambers (6*a*) each with inclined axis is situated downstream each of the nozzles (6).

2. Burner as defined in claim 1, wherein a hole (15) having a vertical axis with respect to the center of the body (1) is formed from the lower gas inlet (4), terminating in the coaxial channel (3*a*) with the nozzle (5) and the upper gas inlet (3) being blocked in the presence of the hole (15).

3. Burner as defined in claim 1, wherein the head (T) is composed of a lower dish (7) and an upper dish (8, 80) that match perfectly, the lower dish (7) having a truncated conical shape and a stepped external border (7*a*) that acts as support and centering for the upper dish (8, 80), the upper dish having a stepped perimeter collar (8*a*), a partition having a top and walls (9), a flat flange (9*a*) being formed on the top of the partition walls, the flange providing support and centering for the upper dish, the flange protruding from the centre of the body (1) and separating the channels (C and E).

4. Burner as defined in claim 3, wherein the lower dish (7) and the upper dish (8, 80) feature semi-conduits (7*b* and 8*b*), respectively, which form the Venturi chambers (6*a*).

5. Burner as defined in claim 3, wherein a V-shaped deflector wall (10) is formed on the lower dish (7), the deflector wall being situated downstream of the chambers (6*a*), wherein the air-gas flow coming from the chambers (6*a*), is bifurcated and is conveyed inside a semi-circular corridor (11) that feeds the concentric external flame (FC).

6. Burner as defined in claim 5, wherein the head (T) comprises an annular cap (13) and a circular cap (14) used to close the corridor (11) and the Venturi chamber (5), respectively; the upper dish (8) is provided with toothed crowns (12) shaped in such a way as to give a horizontal direction to the flames, together with the caps (13 and 14).

7. Burner as defined in claim 5, wherein the head (T) comprises an annular cap (130) and a circular cap (140) that close the corridor (11) and the Venturi chamber (5), respectively; the upper dish (80) having three toothed crowns (12) shaped in such a way as to give a vertically inclined direction to the flames, together with the caps (130 and 140).

* * * * *